US009655452B2

(12) United States Patent
Hoedebecke

(10) Patent No.: US 9,655,452 B2
(45) Date of Patent: May 23, 2017

(54) FURNITURE AND METHODS OF ASSEMBLING THE SAME

(71) Applicant: Andrew Hoedebecke, Edwardsville, IL (US)

(72) Inventor: Andrew Hoedebecke, Edwardsville, IL (US)

( * ) Notice: Subject to any disclaimer, the term of this patent is extended or adjusted under 35 U.S.C. 154(b) by 50 days.

(21) Appl. No.: 14/014,094

(22) Filed: Aug. 29, 2013

(65) Prior Publication Data

US 2015/0061333 A1 Mar. 5, 2015

(51) Int. Cl.

| | |
|---|---|
| ***A47C 3/029*** | (2006.01) |
| ***A47C 7/54*** | (2006.01) |
| ***A47C 7/62*** | (2006.01) |
| ***A47C 7/70*** | (2006.01) |
| ***A47C 9/00*** | (2006.01) |

(52) U.S. Cl.

CPC ..... *A47C 3/029* (2013.01); *A47C 7/54* (2013.01); *A47C 7/62* (2013.01); *A47C 7/70* (2013.01); *A47C 9/00* (2013.01); *Y10T 29/49904* (2015.01)

(58) Field of Classification Search

CPC .. A47C 3/029; A47C 7/54; A47C 7/62; A47C 7/70; A47C 9/00

USPC .... 297/181, 440.11, 440.14, 440.23, 440.16, 297/452.63, 188.01, 188.1, 188.15, 188.2

See application file for complete search history.

(56) References Cited

U.S. PATENT DOCUMENTS

| | | | | |
|---|---|---|---|---|
| 4,211 | A | 9/1845 | Harris | |
| 2,118,676 | A * | 5/1938 | Lankton | 297/452.63 X |
| 3,727,981 | A * | 4/1973 | Ostroff et al. | 297/440.15 |
| 4,225,181 | A * | 9/1980 | Lock et al. | 297/271.6 |
| 5,350,218 | A * | 9/1994 | Perkins | 297/440.1 X |
| 8,333,430 | B2 * | 12/2012 | Adams et al. | 297/239 |
| D679,917 | S * | 4/2013 | Egbert | D6/370 X |
| 8,465,090 | B1 * | 6/2013 | O'Connor | 297/188.01 |
| 2005/0200167 | A1 * | 9/2005 | Bollenbach | A47C 1/14 297/181 X |

* cited by examiner

*Primary Examiner* — Anthony D Barfield

(74) *Attorney, Agent, or Firm* — Armstrong Teasdale LLP

(57) ABSTRACT

A furniture piece is provided. The furniture piece includes a back assembly having a plurality of horizontal supports and a plurality of vertical supports coupled to the plurality of horizontal support. The plurality of vertical supports includes a first indicia shape. An arm assembly is coupled to the plurality of horizontal supports and includes a plurality of arm supports, wherein the plurality of arm supports includes a second indicia shape. The furniture piece includes a leg assembly coupled to the plurality of vertical supports and to the plurality of arm supports. The leg assembly includes a plurality of leg supports, wherein the plurality of leg supports includes a third indicia shape. A seat assembly is coupled to the plurality of vertical supports and the plurality of leg supports. The first indicia shape, the second indicia shape and the third indicia shape include at least one of a profile, silhouette, pattern and scheme of a firearm.

15 Claims, 14 Drawing Sheets

FURNITURE AND METHODS OF ASSEMBLING THE SAME

BACKGROUND OF THE INVENTION

The embodiments described herein relate generally to furniture, and more particularly, to methods and systems used to identify a theme of the furniture.

Furniture such as chairs includes a variety of components such as back supports, legs, arms and seats. Some furniture components are coded with a number or a letter to facilitate identifying, cataloguing, assembling and/or marketing of the furniture. Existing furniture components may not readily present a theme, such as sports or nature, to a consumer when the furniture is displayed to the consumer. Other furniture components may include a graphical representation such as a decal or a print relating to a theme. Existing graphical representations also may not readily present the theme to the consumer.

BRIEF DESCRIPTION OF THE INVENTION

In one aspect, a furniture piece is provided. The furniture piece includes a back assembly having a plurality of horizontal supports and a plurality of vertical supports coupled to the plurality of horizontal support. The plurality of vertical supports includes a first indicia shape. An arm assembly is coupled to the plurality of horizontal supports and includes a plurality of arm supports, wherein the plurality of arm supports includes a second indicia shape. The furniture piece includes a leg assembly coupled to the plurality of vertical supports and to the plurality of arm supports. The leg assembly includes a plurality of leg supports, wherein the plurality of leg supports includes a third indicia shape. A seat assembly is coupled to the plurality of vertical supports and the plurality of leg supports. The first indicia shape, the second indicia shape and the third indicia shape include at least one of a profile, silhouette, pattern and scheme of a firearm.

In another aspect, a chair is provided. The chair includes a back assembly having a plurality of horizontal supports and a plurality of vertical supports coupled to the plurality of horizontal support. The plurality of vertical supports includes a first indicia shape. An arm assembly is coupled to the plurality of horizontal supports and includes a plurality of arm supports, wherein the plurality of arm supports includes a second indicia shape. The chair includes a leg assembly coupled to the plurality of vertical supports and to the plurality of arm supports. The leg assembly includes a plurality of leg supports, wherein the plurality of leg supports includes a third indicia shape. A seat assembly is coupled to the plurality of vertical supports and the plurality of leg supports. The first indicia shape, the second indicia shape and the third indicia shape include at least one of a profile, silhouette, pattern and scheme of a firearm.

In a further aspect, a method of assembling a chair is provided. The method includes forming a plurality of vertical back supports, wherein the vertical back supports includes a first indicia shape. A plurality of arm supports is formed, wherein the arm supports include a second indicia shape. The method further includes forming a plurality of leg supports which have a third indicia shape. In the exemplary method, the plurality of arm supports is coupled to the plurality of vertical back supports. The method includes coupling the plurality of the leg supports to the plurality of vertical back supports and the plurality of arm supports. A seat assembly is coupled to the plurality of leg supports. In the exemplary method, the first indicia shape, the second indicia shape and the third indicia shape include at least one of a profile, silhouette, pattern and scheme of a rifle.

DETAILED DESCRIPTION OF THE INVENTION

The embodiments described herein relate to furniture and methods of assembling the furniture. More particularly, the embodiments relate to indicia shapes for components of the furniture. It should be understood that the embodiments described herein are not limited to chairs and tables, and further understood that the descriptions and figures that utilize a chair and a table are exemplary only. Moreover, while the embodiments illustrate an indicia shape of a firearm, the embodiments described herein may include other indicia shapes.

Figure 1:
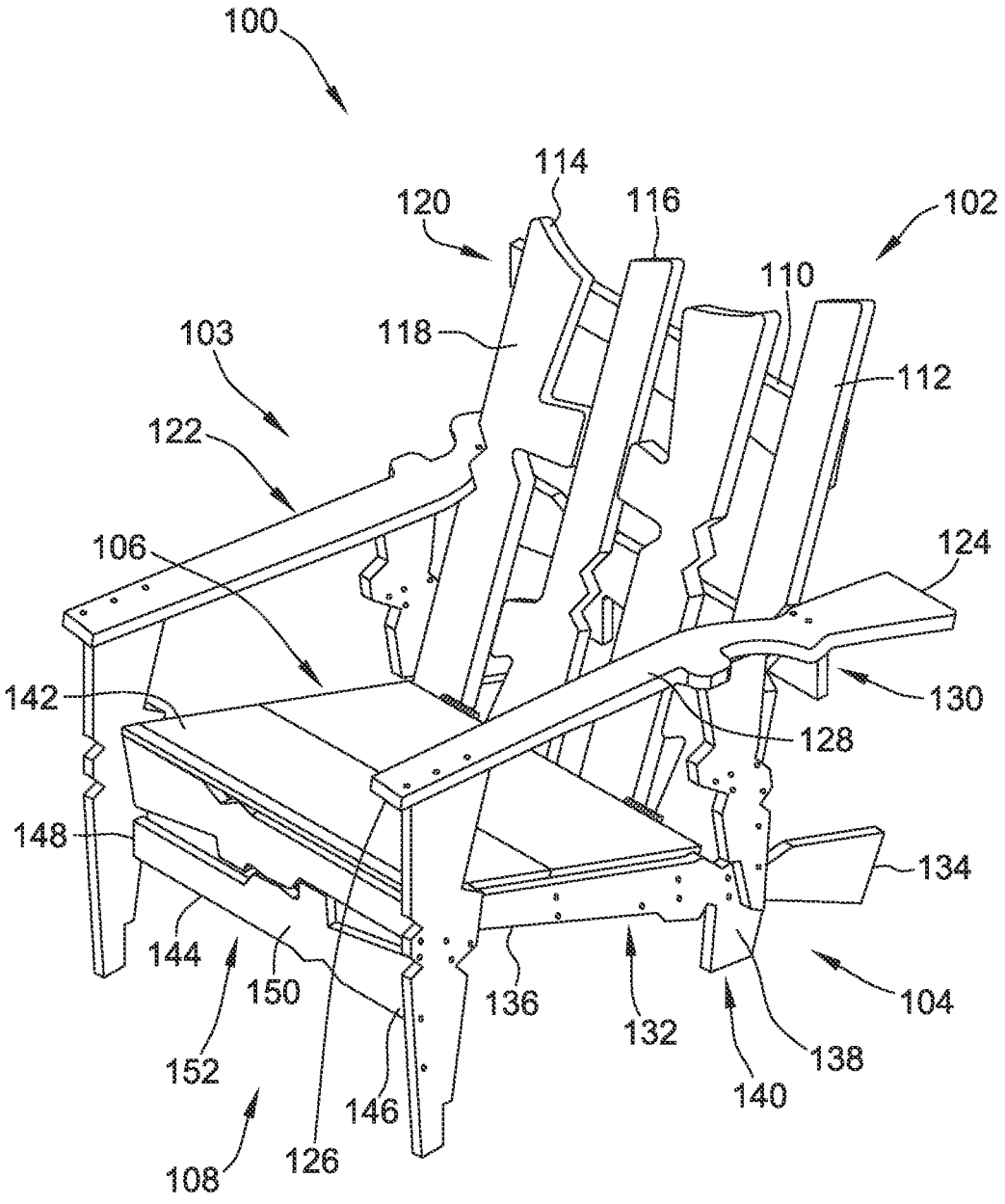
FIG. 1 is a perspective view of an exemplary chair.
Figure 2:
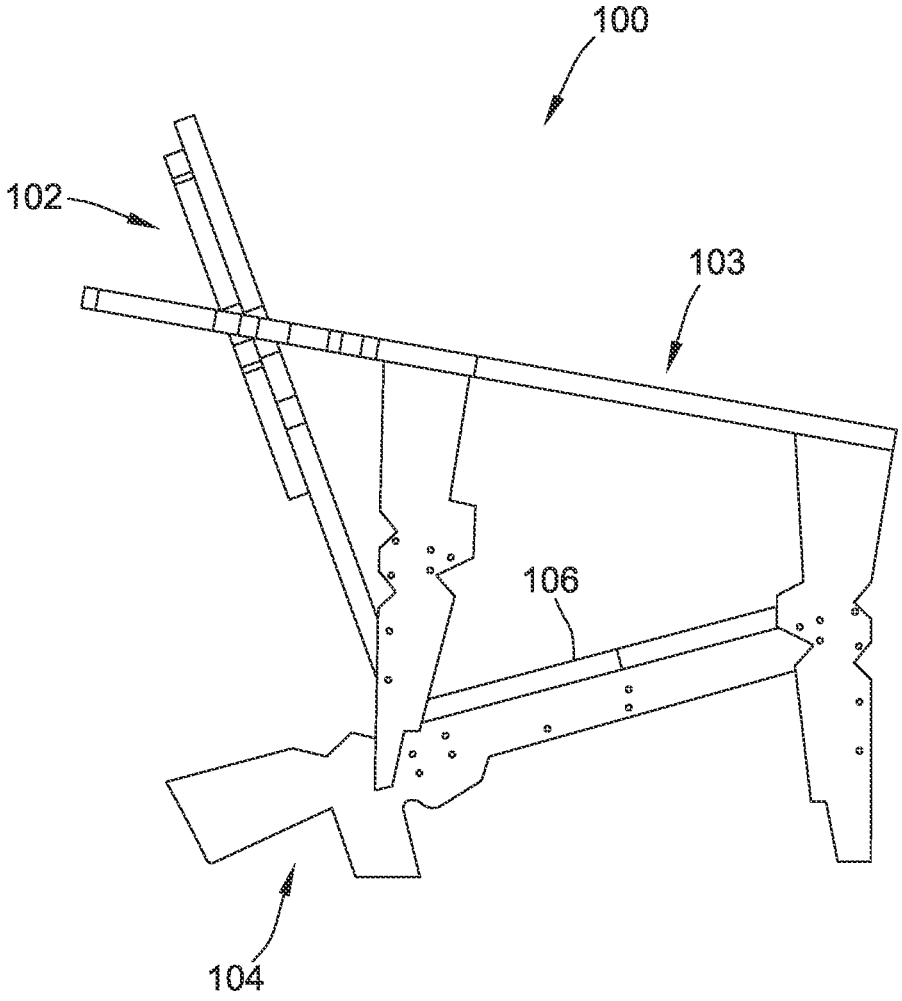
FIG. 2 is a side elevational view of the chair shown in FIG. 1.

FIG. 1 is a perspective view of a furniture piece 100 such as a chair 100. FIG. 2 is a side elevational view of chair 100. Chair 100 includes a back assembly 102, an arm assembly 103, a leg assembly 104, a seat assembly 106 and a support assembly 108. Back assembly 102 includes a plurality of horizontal supports 110 and a plurality of vertical supports 112. The plurality of vertical supports 112 is coupled to the plurality of horizontal supports 110. In the exemplary embodiment, each vertical support includes a first end 114, a second end 116 and portion 118 coupled to and located between first end 114 and second end 116. First end 114, second end 116 and portion 118 are sized and shaped to form a first indicia shape 120.

Arm assembly 103 is coupled to the plurality of horizontal supports 110. Arm assembly 103 includes a plurality of arm supports 122. In the exemplary embodiment, each arm support 122 includes a first end 124, a second end 126 and a portion 128 coupled to and located between first end 124 and second end 126. First end 124, second end 126 and portion 128 are sized and shaped to form a second indicia shape 130. Arm assembly 103 further includes side arm supports coupled to arm support 122 and to leg assembly 104. Side arm supports are sized and shaped to form second indicia shape 130.

Leg assembly 104 is coupled to the plurality of vertical supports 112 and the plurality of arm supports 122. Leg assembly 104 includes a plurality of leg supports 132. In the exemplary embodiment, each leg support 132 includes a first end 134, a second end 136 and a portion 138 coupled to and located between first end 134 and second end 136. First end 134, second end 136 and portion 138 are sized and shaped to form a third indicia shape 140.

Seat assembly 106 is coupled to the plurality of vertical supports 112 and the plurality of leg supports 132. Seat assembly 106 includes at least one surface member 142. In the exemplary embodiment, support assembly 108 is coupled to seat assembly 106 and the plurality of leg supports 132. Support assembly 108 includes a plurality of cross supports 144. In the exemplary embodiment, each cross support 144 includes a first end 146, a second end 148 and a portion 150 coupled to and located between first end 144 and second end 146. First end 146, second end 148 and portion 150 are sized and shaped to form a fourth indicia shape 152.

First indicia shape 120, second indicia shape 130, third indicia shape 140 and fourth indicia shape 152 includes a substantially same shape. Alternatively, first indicia shape 120, second indicia shape 130, third indicia shape 140 and fourth indicia shape 152 may include a different shape. In the exemplary embodiment, first indicia shape 120, second indicia shape 130, third indicia shape 140 and fourth indicia shape 152 include at least one of a profile, silhouette, pattern and scheme of a firearm. More particularly, first indicia shape 120, second indicia shape 130, third indicia shape 140 and fourth indicia shape 152 include at least one of a profile, silhouette, pattern and scheme of at least one of a handgun shape, a rifle shape and a shotgun shape. First indicia shape 120, second indicia shape 130, third indicia shape 140 and fourth indicia shape 152 are sized and shaped to facilitate identifying, cataloguing and assembling chair 100. Moreover, first indicia shape 120, second indicia shape 130, third indicia shape 140 and fourth indicia shape 152 are sized and shaped to readily present a theme such as, but not limited to, a hunting theme, an outdoor theme and a shooting theme to facilitate identifying and/or marketing of chair 100 to a consumer. In the exemplary embodiment, first ends 114, 124, 134 and 144 are sized and shaped in a gun stock shape and second ends 116, 126, 136 and 146 are sized and shaped in a gun barrel shape.

Figure 3:
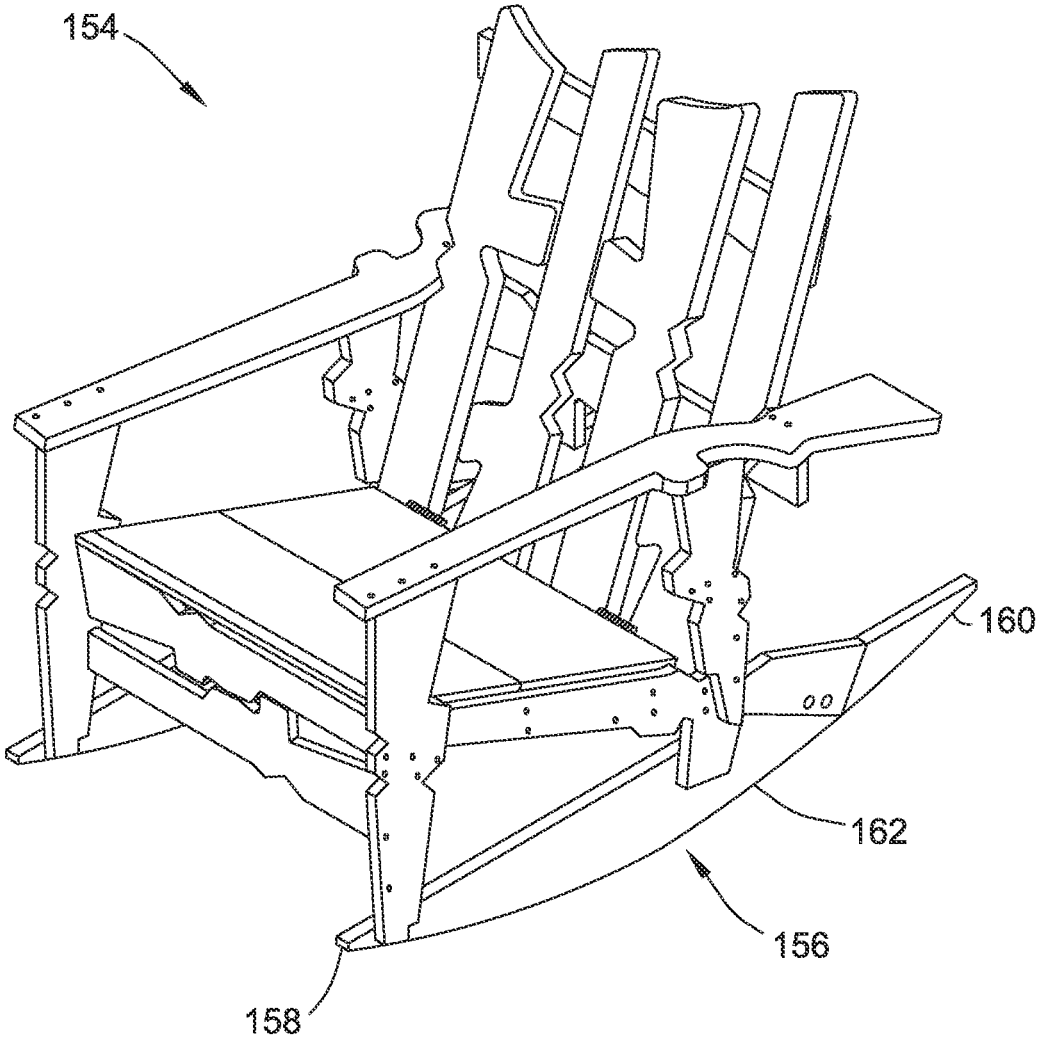
FIG. 3 is a perspective view of another exemplary chair.
Figure 4:
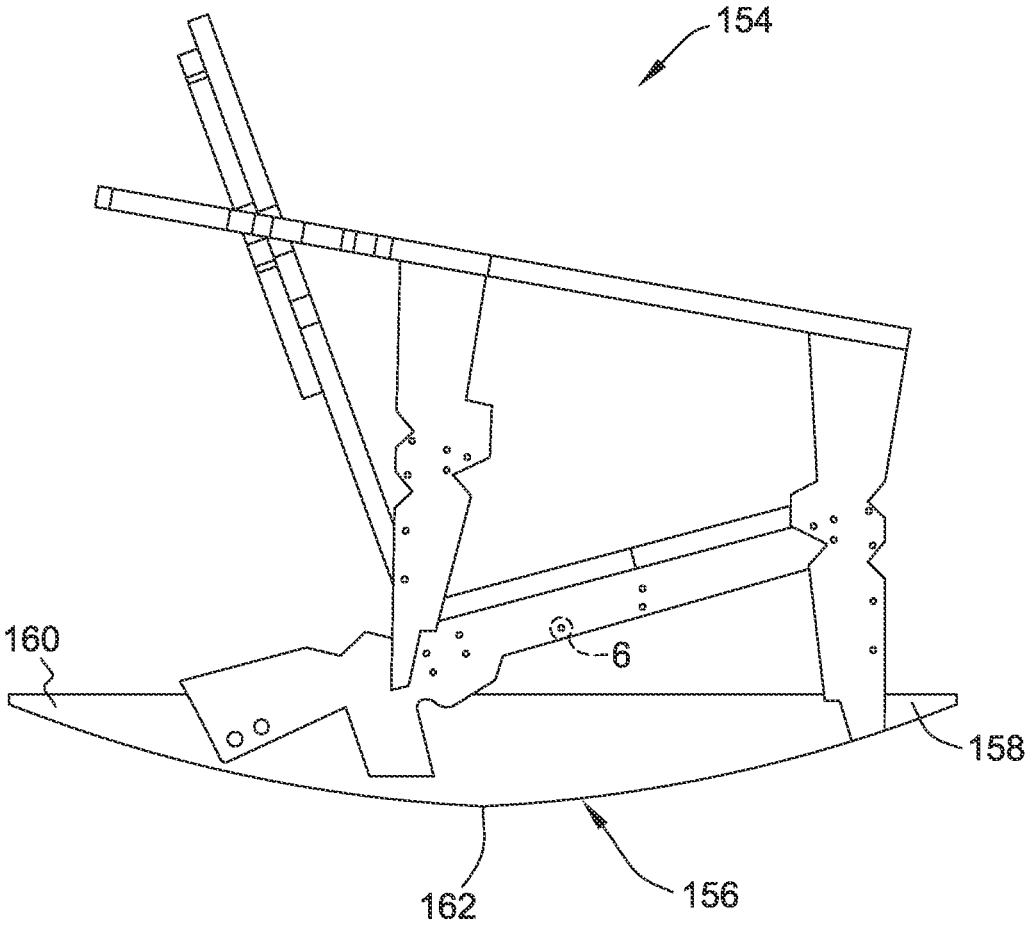
FIG. 4 is a side elevational view of the chair shown in FIG. 3.

FIG. 3 is a perspective view of another exemplary chair 154. FIG. 4 is a side elevational view of chair 154. Chair 154 includes at least one rocker 156 coupled to at least one of leg supports 132. Rocker 156 includes a first end 158, a second end 160 and arcuate portion 162 coupled and located between first end 158 and second end 160. Rocker 156 is configured to partially roll chair 154 between a first position (not shown) and a second position (not shown).

Figure 5:
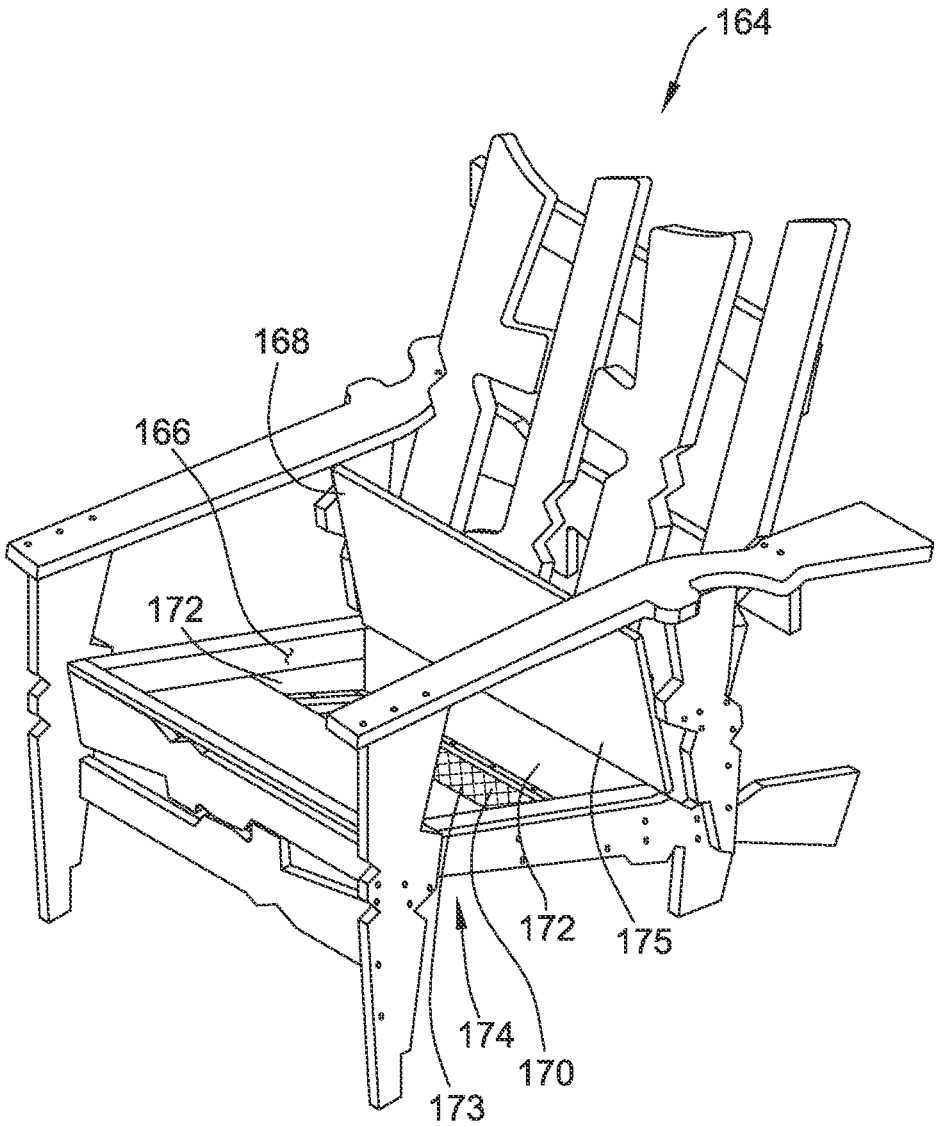
FIG. 5 is a perspective view of another exemplary chair.

FIG. 5 is a perspective view of another exemplary chair 164. Seat assembly includes a lid 168, a bottom 170 and a plurality of side walls 172 coupled to bottom 170. Lid 168, bottom 170 and side walls 172 define a storage compartment 173. Lid 168 is pivotally coupled to at least surface member 142 to move between an open position 174 providing access to storage compartment 173 and a closed position (not shown). Lid 168 includes a plurality of members 175 pivotally coupled to one another to facilitate members folding toward one another when lid 168 is in open position 174. Seat assembly 166 includes a fastener 176 to lock lid 168 in closed position. In the exemplary embodiment, fastener 176 includes a firearm accessory shape. More particularly, fastener 176 includes at least one of a flintlock shape, a cartridge shape and a sight shape. Fastener 176 can include any shape to enable locking of lid 168 and readily present a theme to a consumer.

Figure 6:
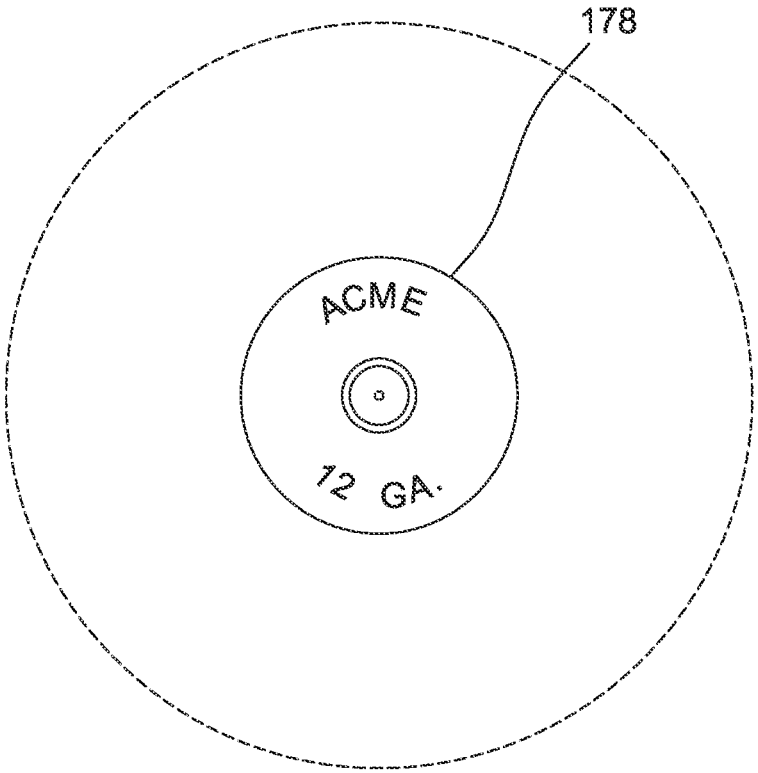
FIG. 6 is a front view of an exemplary fastener for use with the chair shown in FIG. 1.
Figure 7:
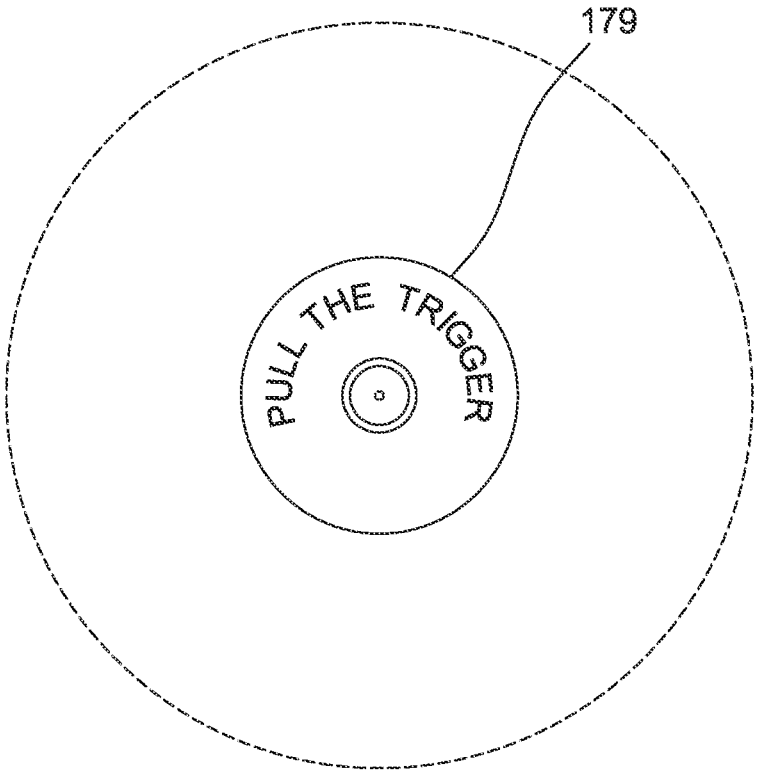
FIG. 7 is a front view of another exemplary fastener for use with the chair shown in FIG. 1.

FIG. 6 is a front view of an exemplary fastener 178 for use with chair 100 shown in FIG. 1. FIG. 7 is a front view of an exemplary fastener 179 for use with chair 100 shown in FIG. 1. Fastener 178 and fastener 179 are configured to couple back assembly 102, arm assembly 103, leg assembly 104, seat assembly 106 and support assembly 108. In the exemplary embodiment, fastener 178 and fastener 179 include a firearm accessory shape. More particularly, fastener 178 and fastener 179 include an ammunition shaped fastener such as a back of a shell. Fastener 178 and fastener 179 can include any shape to enable coupling back assembly 102, arm assembly 103, leg assembly 104, seat assembly 106 and support assembly 108 and readily present a theme to a consumer.

Figure 8:
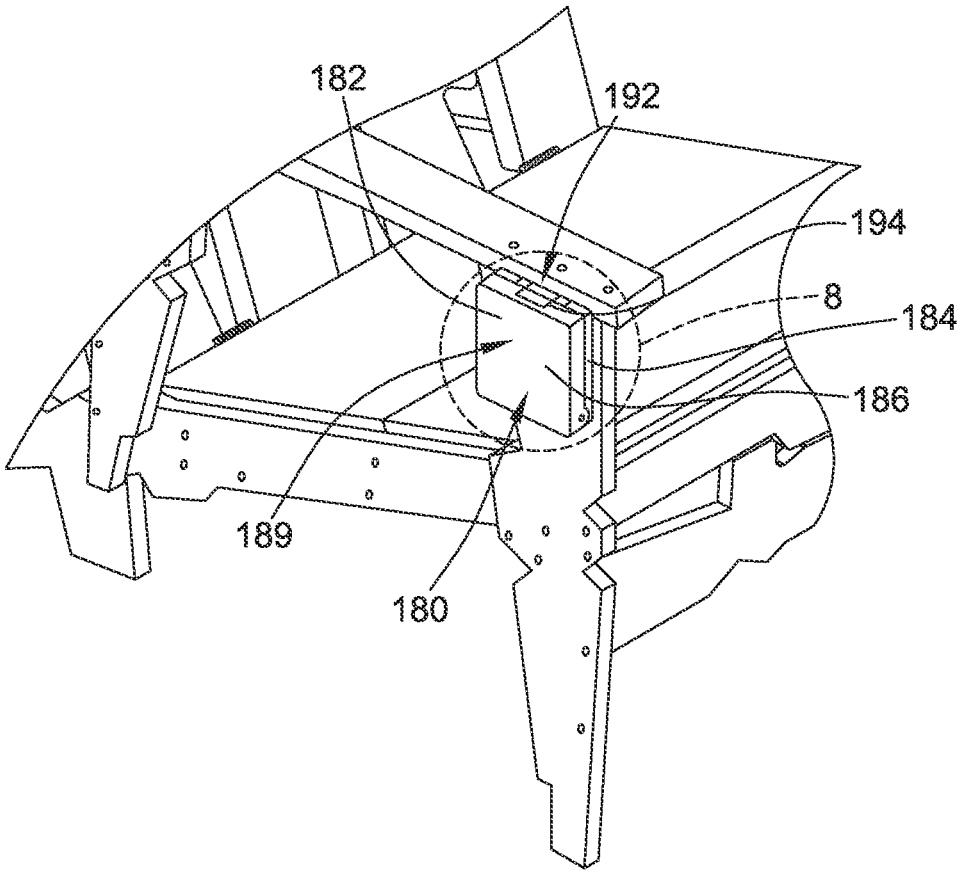
FIG. 8 is partial view of the chair shown in FIG. 1 and an exemplary accessory coupled to the chair.
Figure 9:
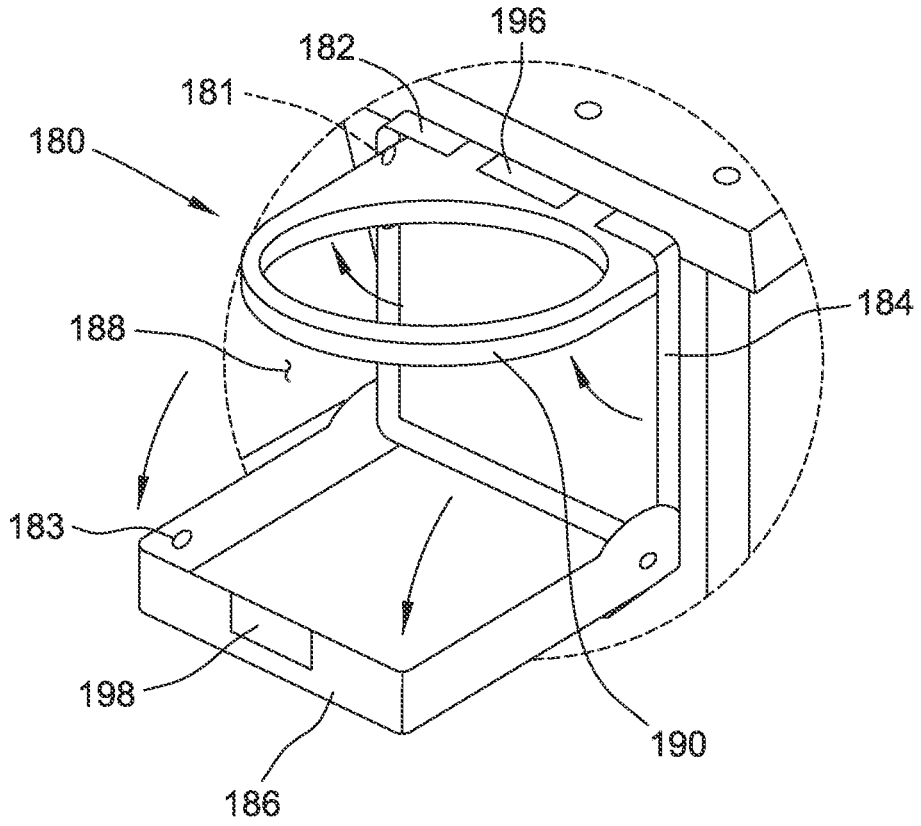
FIG. 9 is a perspective view of the accessory shown in FIG. 7.

FIG. 8 is partial view of chair 100 shown in FIG. 1 and an accessory 180 coupled to chair 100. FIG. 9 is a perspective view of accessory 180 shown in FIG. 8. In the exemplary embodiment, accessory 180 includes a beverage holder 182. Holder 182 includes a support 184 coupled to at least arm support 122 of the plurality of arm supports 122. Holder 182 further includes a base 186 pivotally coupled to support 184. Base 186 is configured to move from an open position 188 (shown in FIG. 9) to a closed position 189 (shown in FIG. 8). Holder 182 includes a first fastener aperture 181 and base 186 includes a second fastener aperture 183. Moreover, holder 182 includes a retainer 190 coupled to support 184. Retainer 190 is sized and shaped to hold a beverage container (not shown).

Figure 10:
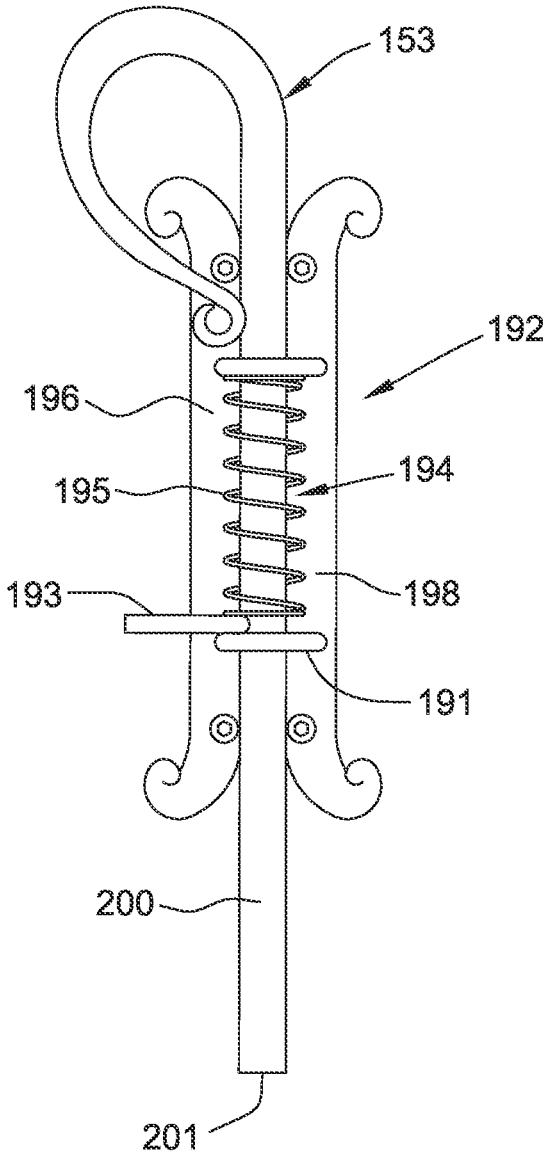
FIG. 10 is a front view of an exemplary fastener for use with the accessory shown in FIGS. 8 and 9.
Figure 11:
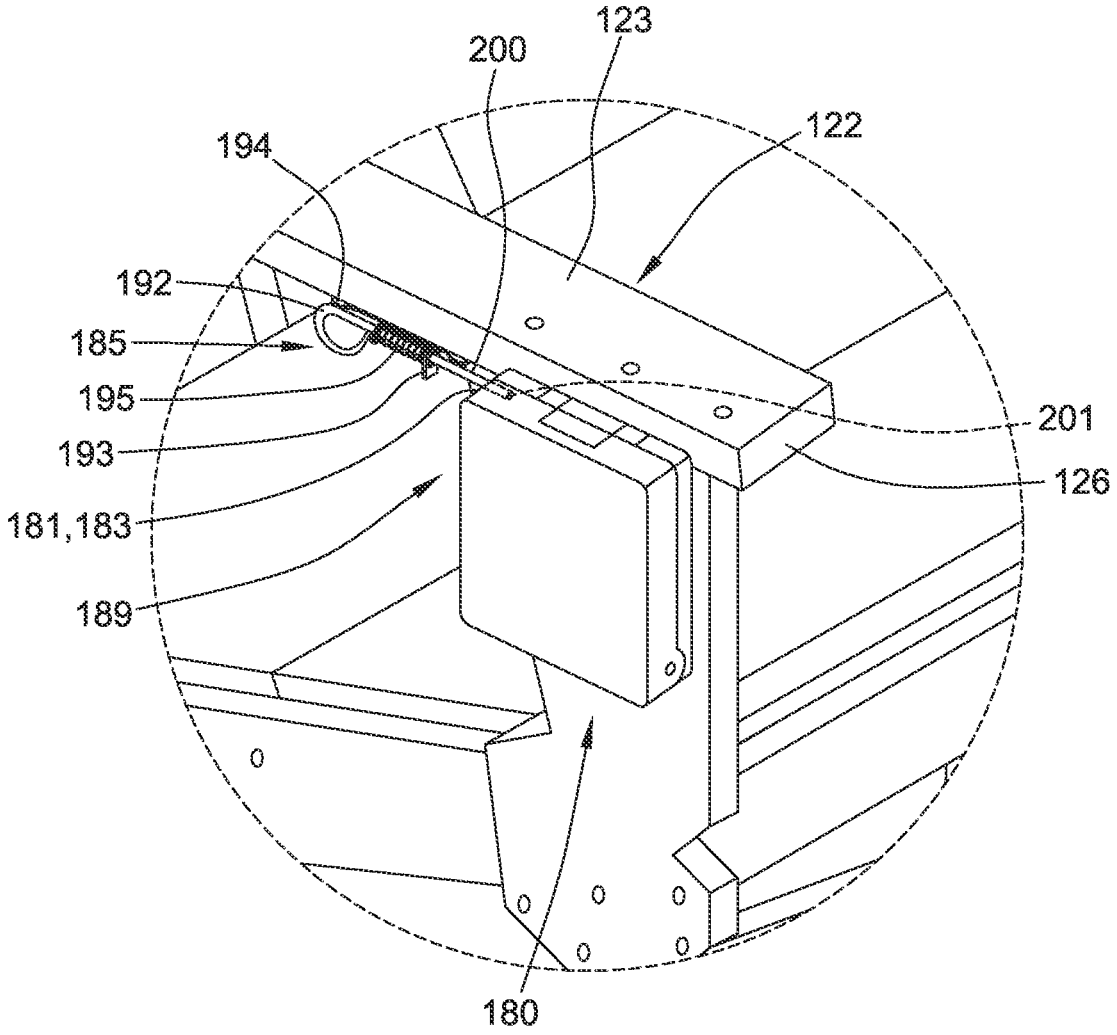
FIG. 11 is a side view of the fastener shown in FIG. 10 coupled to the chair in a first position.
Figure 12:
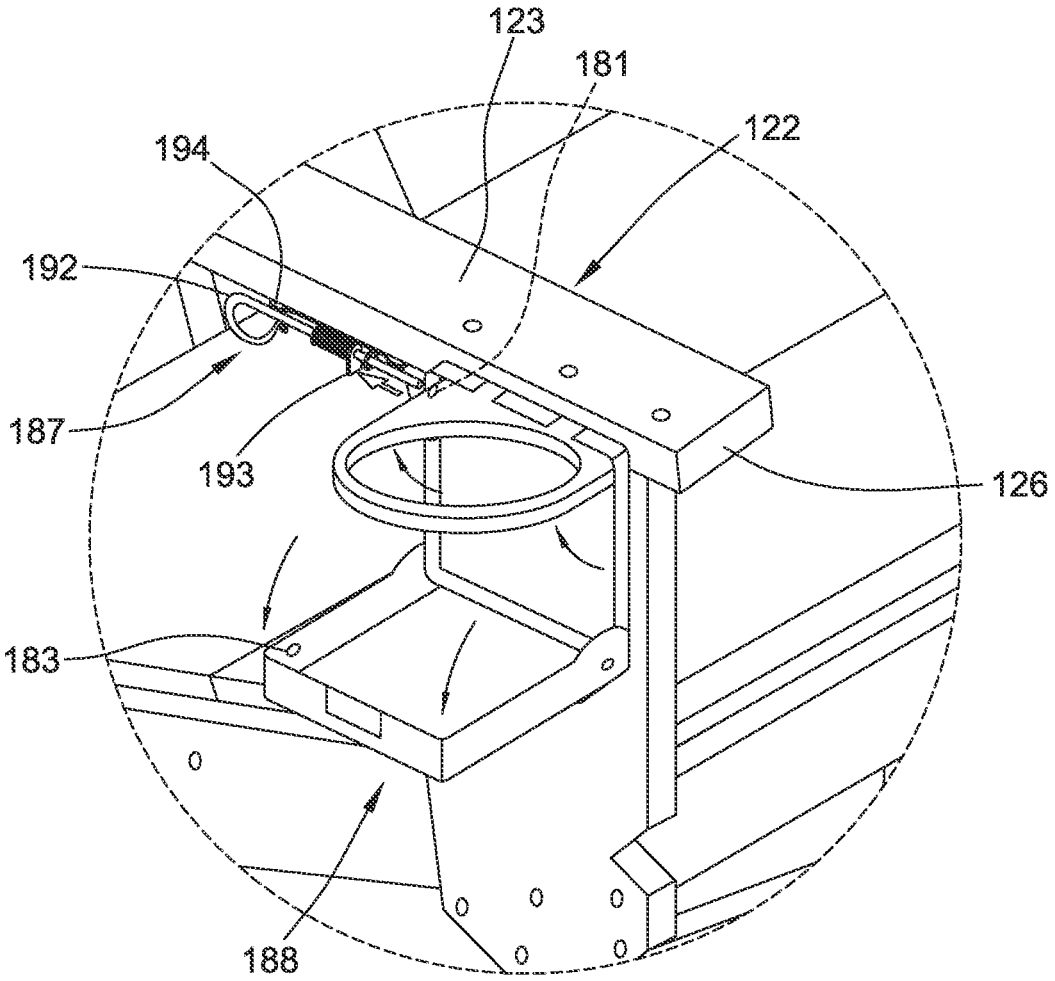
FIG. 12 is a side view of the fastener shown in FIG. 10 coupled to the chair in a second position.

FIG. 10 is a front view of an exemplary fastener 192 for use with accessory 180 shown in FIGS. 8 and 9. FIG. 11 is a side view of fastener 192 coupled to chair 100 in a first position 185. FIG. 12 is a side view of fastener 192 coupled to chair 100 in a second position 187. In the exemplary embodiment, fastener 192 is coupled to at least one arm support 123 of the plurality of arm supports 122. More particularly, fastener 192 is coupled to arm support 123 between end 124 (shown in FIG. 1) and end 126. Alternatively, fastener 192 may be coupled to any location along arm support 123. Fastener 192 has a fifth shape 153 which includes at least one of a profile, silhouette, pattern and scheme of a firearm. More particularly, fifth shape 153 has a shape of pistol such as, but not limited to, a derringer.

Fastener 192 includes a plate 194 having a first plate portion 196 and a second plate portion 198 coupled to arm support 123. Fastener 192 further includes a rod or cane pole 200 having a pole end 201 that slidably couples to first plate portion 196 and second plate portion 198. Pole 200 is moveable from first position 185 when base 186 is in closed position 189 and to second position 187 when base 186 is in open position 188. At least one clip 191, such as a U-shaped clip, couples rod 200 to first plate portion 196 and second plate portion 198. A trigger 193 is coupled to rod 200 to facilitate moving rod 200 from first position 185 to second position 187. A spring 195 is coupled to rod 200 to facilitate moving rod 200, under spring force, from second position 187 to first position 185.

In first position 185, rod end 201 inserts through first fastener aperture 181 and second fastener aperture 183. Moreover, in first position 185, rod 200 is configured to couple to support 184 and base 186 to facilitate coupling base 186 in closed position 189. Spring 195 is configured to apply a spring force to maintain rod 200 in first position 185. A user (not shown) moves trigger 193 against spring force of spring 195 to facilitate moving rod 200 to second position 187. In second position 187, rod end 201 moves out of first aperture 181 and second aperture 183 and decouples from support 184 and base 186. Base 186 is configured to rotate from closed position 189 to open position 188.

In one embodiment, when rod 200 moves from first position 185 to second position 187, base 186 is configured to move to open position 188 under a force of gravity. In another embodiment, when rod 200 moves from first position 185 to second position 187, base 186 is configured to move to open position 188 by a spring force (not shown). Moreover, in one embodiment, when rod 200 moves from first position 185 to second position 187, beverage retainer 190 is configured to move to open position 188 by a spring force (not shown). In another embodiment, when rod 200 moves from first position 185 to second position 187, beverage retainer 190 is configured to move to open position 188 by the user (not shown). Upon release of trigger 193 by user (not shown), spring 195 is configured to move rod 200 to first position 185. Base 186 is configured to move to closed position 189 under at least one of a spring force (not shown) and by user (not shown). Moreover, beverage retainer 190 is configured to move to closed position 189 under at least one of a spring force (not shown) and by user (not shown).

Figure 13:
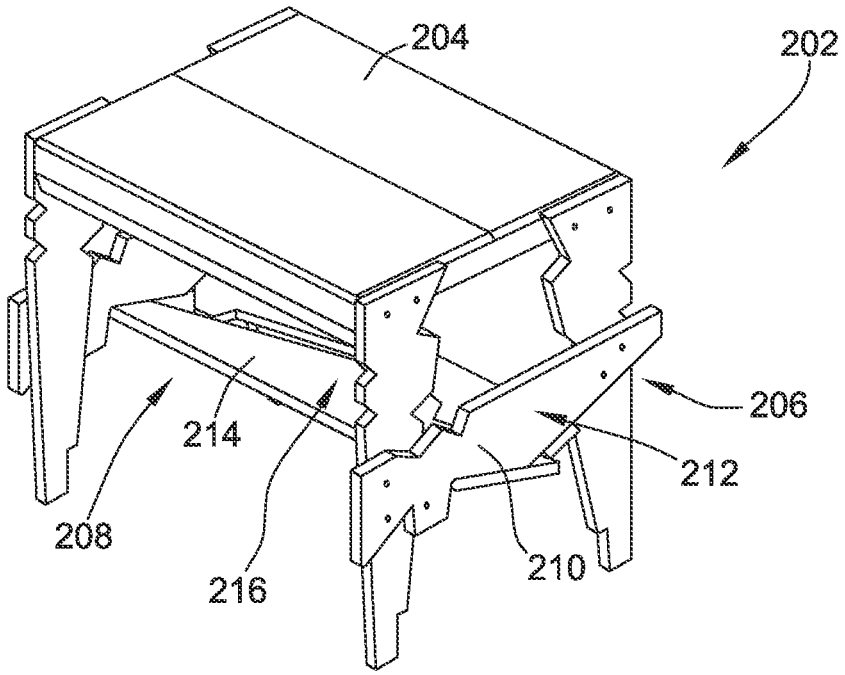
FIG. 13 is a perspective view of an exemplary table.

FIG. 13 is a perspective view of an exemplary table 202. Table 202 includes a planar surface 204, a leg assembly 206 coupled to planar surface 204 and a support assembly 208 coupled to leg assembly 206. Leg assembly 206 includes a plurality of leg supports 210 sized and shaped in a fifth indicia shape 212. Support assembly 208 includes a plurality of supports 214 sized and shaped in a sixth indicia shape 216.

Fifth indicia shape 212 and sixth indicia 216 shape are sized and shaped to facilitate identifying, cataloguing and assembling table 202. Moreover, fifth indicia shape 212 and sixth indicia shape 216 are sized and shaped to readily present a theme such as, but not limited to, a hunting theme, an outdoor theme and a shooting theme to facilitate identifying and/or marketing of table 202 to a consumer.

Figure 14:
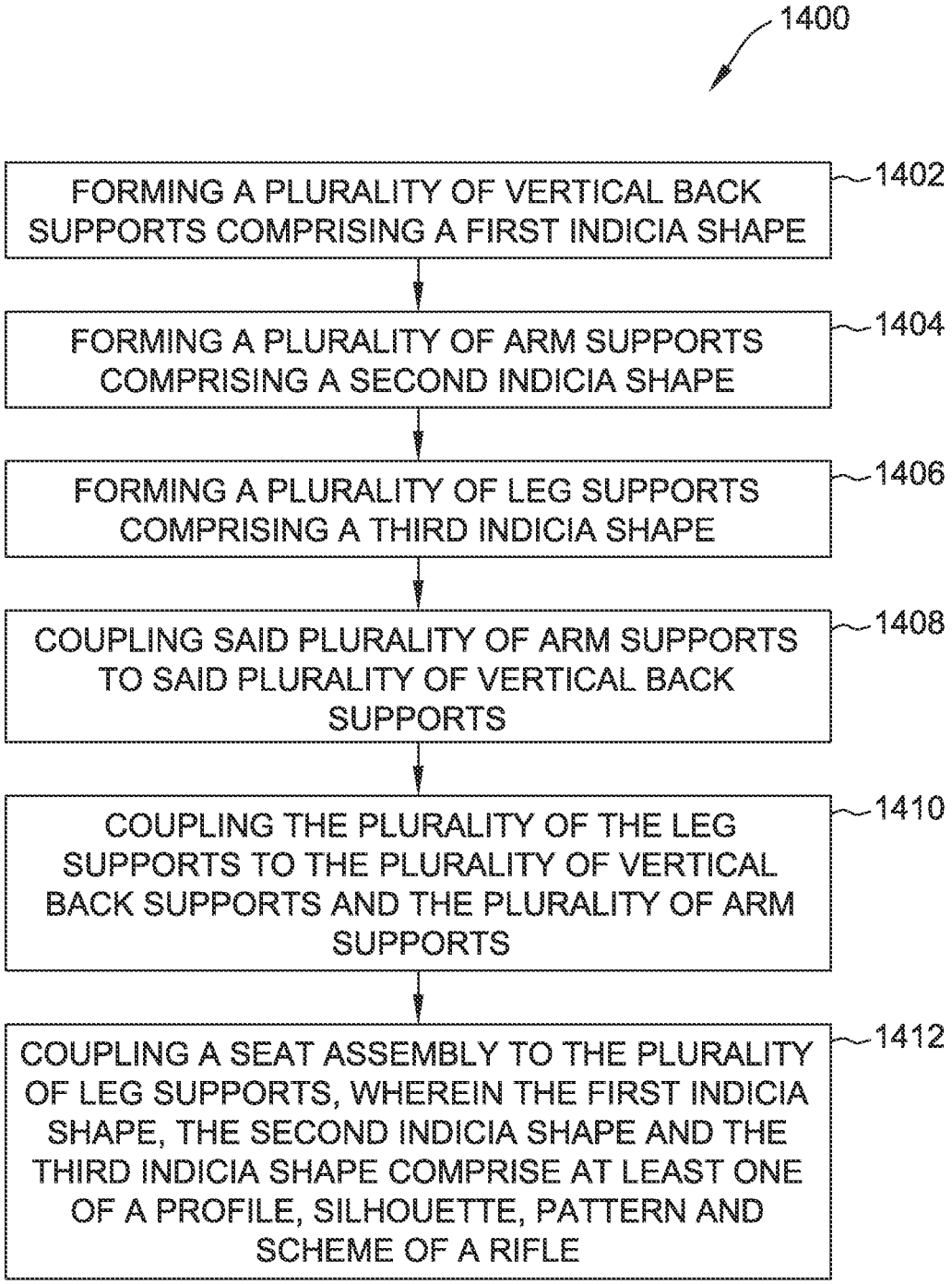
FIG. 14 is an exemplary flowchart illustrating a method of assembling a chair.

FIG. 14 is an exemplary flowchart illustrating a method 1400 of assembling a chair. Method includes forming 1402 a plurality of vertical back supports, for example vertical supports 114 (shown in FIG. 1), wherein the vertical back supports include a first indicia shape, such as first indicia shape 140 (shown in FIG. 1). A plurality of arm supports, for example arm supports 142 (shown in FIG. 1) is formed 1404, wherein the arm supports include a second indicia shape, such as second indicia shape 130 (shown in FIG. 1). Method 1400 further includes forming 1406 a plurality of leg supports, for example leg supports 132 (shown in FIG. 1), wherein the leg supports include a third indicia shape, such as third indicia shape 140 (shown in FIG. 1). In the exemplary method 1400, the plurality of arm supports is coupled 1408 to the plurality of vertical back supports. Method 1400 includes coupling 1410 the plurality of the leg supports to the plurality of vertical back supports and the plurality of arm supports. A seat assembly, for example seat assembly 106 (shown in FIG. 1), is coupled 1414 to the plurality of leg supports. In the exemplary method, the first indicia shape, the second indicia shape and the third indicia shape includes at least one of a profile, silhouette, pattern and scheme of a rifle.

A technical effect of the systems and methods described herein includes at least one of: a back assembly having a first indicia shape, an arm assembly having a second indicia shape, a leg assembly having a third indicia shape, wherein the first indicia shape, the second indicia shape and the third indicia shape comprise at least one of a profile, silhouette, pattern and scheme of a firearm.

Exemplary embodiments of a furniture piece and methods for assembling the furniture piece are described above in detail. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the furniture pieces and methods as described herein. Rather, the exemplary embodiment can be implemented and utilized in connection with many other furniture applications and/or furniture types.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A furniture piece comprising:

a back assembly comprising a plurality of horizontal supports and a plurality of vertical supports coupled to said plurality of horizontal supports, said plurality of vertical supports comprising a first indicia shape;

an arm assembly coupled to said plurality of horizontal supports and comprising a plurality of arm supports and a plurality of side arm supports coupled to said plurality of arm supports, said plurality of arm supports comprising a second indicia shape;

a leg assembly coupled to said plurality of vertical supports and to said plurality of arm supports and comprising:

a plurality of angled leg supports having a first end and a second end, the first end extending beyond said plurality of side arm supports and spaced from a ground surface, wherein a portion of said plurality of angled leg supports between the first and second ends is configured to contact the ground surface, said plurality of angled leg supports comprising a third indicia shape; and a plurality of vertical leg supports directly coupled to the second end of said plurality of angled leg supports and to said plurality of arm supports, wherein said plurality of side arm supports are directly coupled to the portion of said plurality of angled leg supports between the first and second ends such that each angled leg support of said plurality of angled leg supports contacts at least one vertical leg support of said plurality of vertical leg supports and at least one side arm support of said plurality of said side arm supports, wherein said plurality of side arm supports overlap said plurality of angled leg supports and are spaced from the ground surface; and a seat assembly coupled to said plurality of vertical supports and said plurality of angled leg supports, wherein said first indicia shape, said second indicia shape and said third indicia shape comprise at least one of a profile, silhouette, pattern and scheme of a firearm.

2. The furniture piece of claim 1, wherein said first indicia shape, said second indicia shape and said third indicia shape comprise a substantially same indicia shape.

3. The furniture piece of claim 1, wherein said first indicia shape, said second indicia shape and said third indicia shape comprise a different indicia shape.

4. The furniture piece of claim 1, wherein said at least one of a profile, silhouette, pattern and scheme of a firearm comprises at least one of a handgun shape, a rifle shape and a shotgun shape.

5. The furniture piece of claim 1, further comprising a cross support coupled to said seat assembly and said plurality of vertical leg supports and comprising a fourth indicia shape, said fourth indicia shape comprising at least one of a profile, silhouette, pattern and scheme of a firearm.

6. The furniture piece of claim 1, further comprising an accessory holder coupled to at least one arm support of said plurality of arm supports.

7. The furniture piece of claim 6, further comprising a fastener coupled to accessory holder, said fastener comprising a movable rod configured to move from a first position to a second position to facilitate moving said accessory holder from a closed position to an open position.

8. The furniture piece of claim 1, wherein said seat assembly comprises a storage compartment.

9. The furniture piece of claim 1, wherein said seat assembly comprises a storage compartment and a firearm accessory shaped fastener.

10. The furniture piece of claim 1, further comprising a firearm accessory shaped fastener.

11. The furniture piece of claim 1, further comprising an ammunition shell shaped fastener.

12. A chair comprising:

a back assembly comprising a plurality of horizontal supports and a plurality of vertical supports coupled to said plurality of horizontal supports, said plurality of vertical supports comprising a first indicia shape;

an arm assembly coupled to said plurality of horizontal supports and comprising a plurality of arm supports and a plurality of side arm supports coupled to said plurality of arm supports, said plurality of arm supports comprising a second indicia shape;

a leg assembly coupled to said plurality of vertical supports and to said plurality of arm supports and comprising:

a plurality of angled leg supports having a first end and a second end, the first end extending beyond said plurality of side arm supports and spaced from a ground surface, wherein a portion of said plurality of angled leg supports between the first and second ends is configured to contact the ground surface, said plurality of angled leg supports comprising a third indicia shape; and a plurality of vertical leg supports directly coupled to the second end of said plurality of angled leg supports and to said plurality of arm supports, wherein said plurality of side arm supports are directly coupled to the portion of said plurality of angled leg supports between the first and second ends such that each angled leg support of said plurality of angled leg supports contacts at least one vertical leg support of said plurality of vertical leg supports and at least one side arm support of said plurality of said side arm supports, wherein said plurality of side arm supports overlap said plurality of angled leg supports and are spaced from the ground surface; and a seat assembly coupled to said plurality of vertical supports and said plurality of angled leg supports, wherein said first indicia shape, said second indicia shape and said third indicia shape comprise at least one of a profile, silhouette, pattern and scheme of a rifle.

13. The chair of claim 12, further comprising a cross support coupled to said seat assembly and said plurality of vertical leg supports and comprising a fourth indicia shape, said fourth indicia shape comprising at least one of a profile, silhouette, pattern and scheme of the rifle shape.

14. The chair of claim 12, wherein said plurality of side arm supports are positioned proximate to said back assembly.

15. The chair of claim 12, wherein said plurality of angled leg supports at least partially define a storage compartment.

* * * * *